US005979063A

United States Patent [19]

Pritz

[11] Patent Number: 5,979,063

[45] Date of Patent: Nov. 9, 1999

[54] SHEET ROCK CUTTING TOOL

[76] Inventor: William A. Pritz, 5914 N. Hasbrook Ave., Philadelphia, Pa. 19120

[21] Appl. No.: 09/045,143

[22] Filed: Mar. 20, 1998

[51] Int. Cl.[6] ..... B26B 29/06

[52] U.S. Cl. ..... 30/293; 30/294

[58] Field of Search ..... 30/293, 294, 383; 33/419, 427, 464

[56] References Cited

U.S. PATENT DOCUMENTS

| | | | |
|---|---|---|---|
| 2,818,644 | 1/1958 | Crawford . | |
| 3,286,351 | 11/1966 | McAlister . | |
| 4,233,739 | 11/1980 | Hinrichs | 30/383 |
| 4,644,663 | 2/1987 | Needs . | |
| 4,799,315 | 1/1989 | Ziegler . | |
| 4,949,462 | 8/1990 | Spencer . | |
| 5,197,195 | 3/1993 | Aikens . | |
| 5,265,342 | 11/1993 | Lang, Jr. . | |
| 5,600,892 | 2/1997 | Peugh et al. | 30/293 X |

*Primary Examiner*—Douglas D. Watts
*Attorney, Agent, or Firm*—Buchanan Ingersoll, P.C.

[57] ABSTRACT

A sheet rock measuring and cutting device, comprising: a T-square arm for abutment with an edge of a piece of sheet rock; a base scale arm positioned within the T-square arm for selective sliding interengagement therewith; and a sliding scale arm positioned within the base scale arm for selective sliding interengagement therewith. The sliding scale arm includes a cutting tool engagement member for receipt and positioning of a cutting tool at a measured distance from the edge of the sheet rock.

12 Claims, 2 Drawing Sheets

SHEET ROCK CUTTING TOOL

FIELD OF THE INVENTION

The present invention relates to a sheet rock cutting tool for cutting sheet rock or the like. More particularly, the present invention relates to a sheet rock cutting tool wherein a cutting tool is positioned within a sliding scale arm at a measured distance from a T-square arm allowing for measurement and cutting, or scoring, of a piece of sheet rock in a single motion. The sliding scale arm is positioned within a base scale arm for selective sliding interengagement therewith; a base scale arm is in turn positioned within the T-square arm for selective sliding interengagement therewith.

BACKGROUND OF THE INVENTION

Many tools have been made to facilitate the measurement and/or cutting or scoring of a piece of sheet rock to a desired size for use in the construction of building walls and ceilings.

For example, U.S. Pat. No. 5,197,195 to Aikens describes a cutting guide apparatus having an elongate handle containing a magazine housing including a reel of flexible measuring tape extending through a guide plate that is adjacent a distal end of the handle. A collet member permits selective extension of the measuring tape and the forward distal end of the flexible measuring tape includes a support beam including a mount for a writing instrument and a cutting tool therein. However, the flexible nature of the measuring tape does not permit a rigid member to insure an accurate marking/scoring/cutting by a mounted writing instrument or cutting tool. This is especially relevant at greater extensions of the flexible tape from the handle and increases the difficulty of its use.

U.S. Pat. No. 5,265,342 to Lang describes a drywall measuring and cutting tool having a guide riding the edge of a sheet of drywall and a rigid, graduated rod passing through an opening in the guide and normal thereto. A knife is fastened to the rod by a stem assembly and the stem assembly can be rotated for shallow or deep cuts. However, the idle rod length projects away from the knife through the guide which requires a minimum free space behind the sheet of drywall, especially for cuts closer to the guide. Additionally, the rod is selectively fixed within the guide by a downward pressure of the handle of the guide towards the rod which tends to lift the knife end away from the drywall and increases the difficulty in manipulating the device to cut or score the sheet of drywall. Also, since the depth of the score/cut is determined by rotation of the stem assembly, the user must exert a constant and consistent downward pressure on the handle of the stem assembly to ensure a consistent depth of scoring/cutting. This further complicates use of the device.

U.S. Pat. No. 2,818,644 to Crawford describes a wallboard measuring and cutting device having a sliding stop member with a flat, rigid, elongated calibrated rod passing through an opening in the stop member and normal thereto. Secured to one end of the rod is a block member which extends transversely to the rod. The block member includes a cutting blade perpendicular to the rod and selectively positioned to score or cut a sheet of drywall or the like. The opposite end of the rod includes a depending stop block which prevents removal of the sliding stop member. In use, the sliding stop member is selectively positioned along the calibrated rod at a specified distance from the cutting blade as read by the markings on the rod and is fixed in position by a pivoting arm having a curved bottom which frictionally engages the rod. The sliding stop member projects below the plane of the bottom of the calibrated rod and includes an edge which abuts the edge of a sheet of drywall. The device is guided along the edge of the drywall scoring/cutting the drywall at the specified distance. However, as in Lang, the idle rod length projects away from the block member/cutting blade which requires a minimum free space behind the sheet of drywall, especially for cuts closer to the sliding stop member.

U.S. Pat. No. 3,286,351 to McAlister describes a sheetrock scriber which scribes, or scores, a piece of sheetrock, or the like, at a predetermined distance so that the sheetrock can be accurately broken off to the desired size. The sheetrock scriber having a carriage riding over a piece of sheetrock on a set of tandem rollers on one end and a single roller positioned on a scriber head member at the other end of a ruler arm extending from the carriage. The tandem rollers are spaced and journaled on a vertically extending leg and are journaled on individual axles. The vertically extending leg has an edge with beveled lips angling outwardly to facilitate abutment of the leg with an edge of the sheetrock. The ruler arm may be suitably graduated to allow measured placement of a scriber blade within the scriber head member at the desired distance from the edge of the vertically extending leg. The scriber head member is selectively positioned along the ruler arm by squeezing of a lever member against the scriber head member to clamp the ruler arm at the desired distance. The scriber blade projects below the single roller at a predetermined fixed distance to ensure proper scribing of the sheetrock.

However, similar to Lang and Crawford, the idle ruler arm length projects away from the vertically extending leg which requires a minimum free space behind the sheetrock, especially for cuts closer to the vertically extending leg. Further, the rollers upon which the carriage/ruler arm rides over the sheetrock are subject to binding upon embedding of pieces of scribed sheetrock and dust in their axles/sleeves produced during use of the device. This could lead to necessary periodic cleaning of the roller members and difficulty in the efficient use of the device due to difficult scribes and may lead to binding or jumping of the device creating nonlinear scribes and therefore nonlinear breaking of the sheetrock.

U.S. Pat. No. 4,644,663 to Needs describes a measuring device to locate, dimension and mark the proper locations for the successive formations of score lines in a plurality of multi-sided conduits or ducts formed from planar sheets of duct board without having to reset the device each time a separate duct board is marked. The measuring device being in the form a T-square having a rigid, elongated body and a perpendicularly arranged head portion and further including a plurality of staggered, offset scales extending along the length of the body in adjacent, side-by-side and parallel relation to one another from the head portion towards a distal end. A plurality of scale indicators, preferably equal in number to the number of scales, are positioned to slide along the length of the body in aligned indicating relation with one of the plurality of scales. Each scale indicator includes a locking member to selectively lock each scale indicator relative to its respective scale. Each scale indicator further includes a marker member extending outwardly therefrom and positioned to allow markings to be made on the product being measured by the device by each scale indicator marker member as determined by the locked position of the scale indicator relative to the measurement indicia on its respective scale. The device is intended to allow for accurate multiple V-shaped scorings of successive duct boards so that each scored duct board may be folded upon itself along the score lines to form multiple, identical substantially rectangularly-shaped ducts or conduits that may then be affixed to each other end-to-end to create, most commonly, air conditioning ducts. Each V-shaped score line has a definite width which must be accounted for to allow proper placement of the next and successive score lines to allow formation of the selected sized duct. The scales are staggered a predetermined amount relative to each other to account for the V-shaped score line width.

In use, the device is set so that the side-by-side scales are offset an appropriate amount for the size of the duct to be formed and the marker members are locked at the desired positions. Marks are made at each marker member at either end of the duct boards and a straight edge is used to connect the pairs of marks made by the device to indicate along the entire appropriate dimension of the duct board where the V-shaped score lines are to be cut by a separate tool. The Needs device is not designed to make continuous score lines to cuts but is instead designed to account for the width of the V-shaped score lines, to be subsequently produced by a separate tool, necessary to form rectangular-shaped ducts from the duct boards. Further, the device is not compact and is of a fixed length creating an unnecessarily bulky and unwieldy device for simple scoring or cutting of a sheet of material to a single desired width.

U.S. Pat. No. 4,949,462 to Spencer describes a drywall cutting device that includes a channel-shaped sleeve for slidably mounted disposition on a stem of a T-square at predetermined selectable positions. A handle operated clamping device consisting of a screw inserted in a threaded hole in the sleeve that may be rotated so that the screw's distal end engages the stem of the T-square is provided to selectively position the sleeve on the stem. The sleeve further includes a knife holder within which a knife is positioned perpendicular to the stem for cutting a line perpendicular to the stem when the clamping device and the T-square are drawn together across a surface to be cut. The stem may include graduated indicia to establish the measured distance from the knife edge to the edge of the T-square engaging the edge of the sheet of the material to be cut. As with Needs, McAlister, Crawford, and Lang, the device is not compact but instead is of a fixed length creating an unnecessarily bulky and unwieldy device.

U.S. Pat. No. 4,799,315 to Ziegler describes a knife support and cutting guide for a type of cutting tool commonly used to cut paperboard as a border for framing pictures. The device having a two piece clamp at the end of a curved arm for holding the cutting tool while the other end of the curved arm has a first circular member which mates with a corresponding second circular member on the end of an elongated rod to selectively maintain the curved arm at a predetermined rotational orientation relative to the elongated rod by the use of a screw, for example. One of two interchangeable, surface engaging guide members is releasably retained at a desired position along the length of the rod permitting the cutting tool to make either a circular or a straight cut in the paperboard with a beveled edge. The rotational adjustment of the two circular members permits alignment of the cutting tool edge when making circular cuts to eliminate blade drag. The elongated rod is selectively slidingly engaged to the surface engaging guide members through a hole therein to allow for selective adjustment of the distance from the cutting tool to the chosen surface engaging guide member. To make straight cuts, a flat edged surface engaging guide member is chosen to produce a T-square shaped device with the elongated rod perpendicularly attached to the flat edge member. The flat edge member abuts the edge of the material to be cut and the flat edge member and cutting tool is drawn along the edge of that material to cut the material at a predetermined distance from its edge.

As with Needs, McAlister, Crawford, Lang, and Spencer, the Ziegler device is not compact but instead is of a fixed length creating an unnecessarily bulky and unwieldy device. Further, the device is of a relatively flimsy construction for cutting sheet rock over prolonged periods and is not provided with calibrated indicia to permit rapid and accurate measured scoring or cutting. None of the prior art patents disclose a compact sheet rock scoring/cutting device that is useful over the range of measured distances for common sheet rock.

Accordingly, it is an object of this invention to provide a sheet rock cutting tool that is compact while extendible to allow cutting of standard sizes of sheet rock.

Another object of the present invention is to provide a tool that permits measuring and scoring or cutting sheet rock in a single motion.

Other objects will appear hereinafter.

SUMMARY OF THE INVENTION

It has now been discovered that the above and other objects of the present invention may be accomplished in the following manner. Specifically, the present invention provides a T-square arm for abutment with an edge of a piece of sheet rock; a base scale arm positioned within the T-square arm for selective sliding interengagement therewith; and a sliding scale arm positioned within the base scale arm for selective interengagement therewith. The sliding scale arm includes a cutting tool engagement member for receipt and positioning of a cutting tool at a measured distance from the T-square arm such that a piece of sheet rock may be measured and cut or scored in one motion.

In the preferred embodiment, the T-square arm includes a body having upwardly curved sides and an arm perpendicular to the body. The arm has a leading edge for abutment with the edge of the piece of sheet rock. The base scale arm has graduated indicia thereon increasing from left to right from twelve to twenty-four inches and further has upwardly curved sides. The base scale arm is positioned within the T-square body and retained by the upwardly curved T-square arm body sides for selective sliding interengagement therewith. The sliding scale arm has graduated indicia thereon increasing from right to left from zero inches to twelve inches and is positioned within the upwardly curved base scale arm sides for selective sliding interengagement therewith.

A first threaded opening pierces the body of the T-square arm and is sized to receive a first thumb screw and is positioned such that threading the first thumb screw into the first threaded opening causes the end of the first thumb screw to engage the base scale arm to selectively fix the base scale arm within the T-square arm body. Two projections are positioned on the left side of the sliding scale arm a predetermined distance apart. A generally square shaped plate, sized to fit within the base scale arm, rests on the sliding scale arm between the projections. The plate is pierced by a second threaded opening centered therein and is positioned and sized to receive a second thumb screw such that threading the second thumb screw into the second threaded opening causes the end of the second thumb screw to engage the sliding scale arm and press the plate upwardly against a portion of the base scale arm sides to selectively fix the sliding scale arm within the base scale arm.

The left underside of the base scale arm includes a downwardly projecting tab and the left side of the body of the T-square arm includes a cut-out sized for receipt of the projecting tab wherein engagement of the tab with the cut-out limits the left-most positioning of the T-square arm on the base scale arm. A stop plate is fixedly mounted on the right end of the sliding scale arm and is sized to abut the right end of the base scale arm wherein abutment of the stop plate with the right end of the base scale arm limits the left-most positioning of the sliding scale arm within the base scale arm.

A first diamond shaped opening piercing the right end of the sliding scale arm and a second diamond shaped opening piercing the stop plate are in alignment. These first and second diamond shaped openings are sized for receipt of a cutting blade of the cutting tool at a measured distance from the T-square arm such that when the T-square arm is fixed at its left-most position on the base scale arm, and the sliding scale arm is fixed at its left-most position within the base scale arm, the distance from the leading edge to the cutting edge of the cutting blade is twelve inches.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
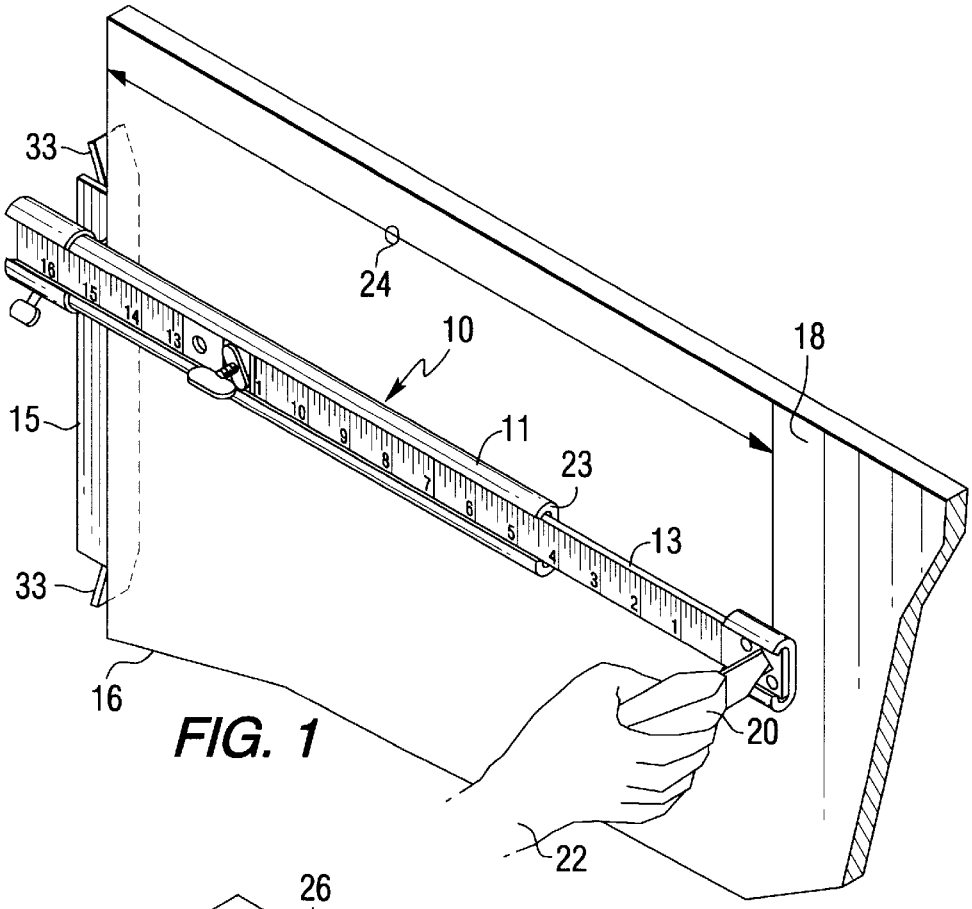
FIG. 1 is a perspective view of the preferred embodiment of the sheet rock cutting tool positioned on a piece of sheet rock, all in accordance with the invention.
Figure 2:
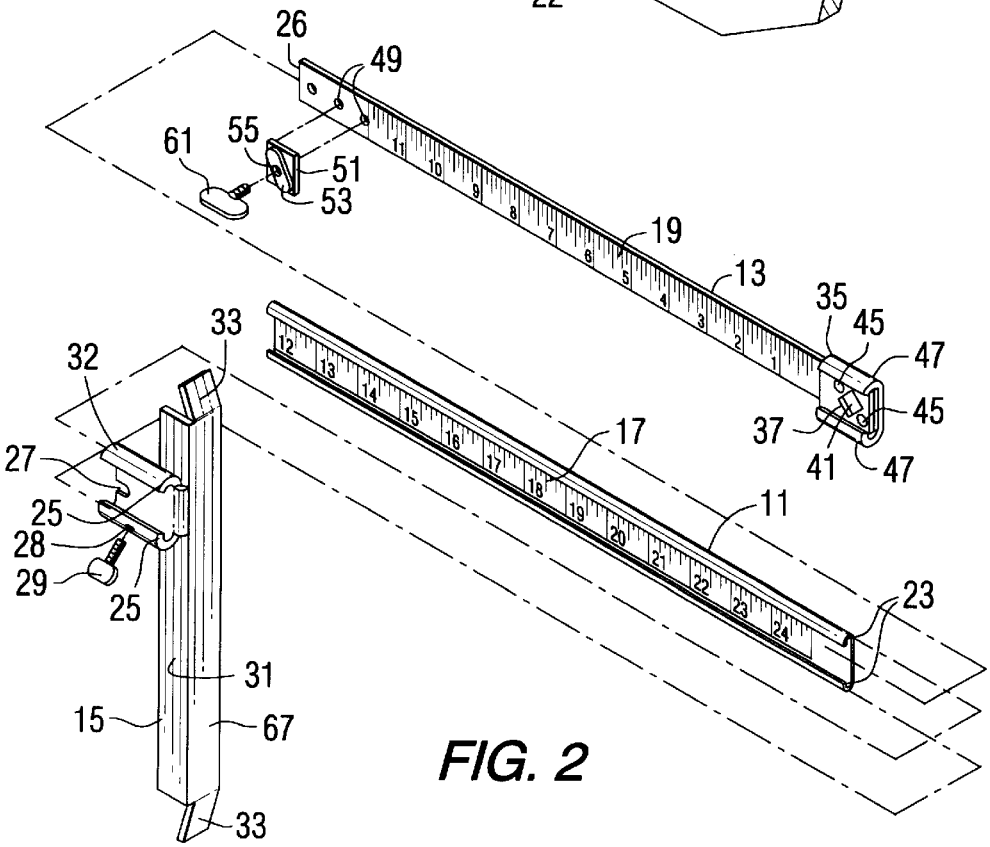
FIG. 2 is an exploded perspective view of the sheet rock cutting tool shown in FIG. 1.

As shown in the drawings, and specifically in FIGS. 1 and 2, a sheet rock cutting tool made in accordance with the present invention, generally indicated as 10, includes: T-square arm 15 having leading edge 67 for abutment with an edge 16 of a piece of sheet rock 18; base scale arm 11 positioned within T-square arm 15 for selective sliding interengagement therewith; and sliding scale arm 13 positioned within base scale arm 11 for selective sliding interengagement therewith. Sliding scale arm 13 includes cutting tool engagement member 14 for receipt and positioning of a cutting tool 20 held by a user 22 at a measured distance 24 from leading edge and sheet rock edge 67 and 16, respectively. Device 10 may be manufactured from metal, such as aluminum, although it is preferably made of plastic or a similar material which reduces manufacturing costs.

In the preferred embodiment, T-square arm 15 includes channel shaped body 32, having curved retaining sides 25, and arm 31 perpendicular to body 32. Each end of arm 31 includes beveled lips 33 angling outwardly to facilitate abutment of leading edge 67 of arm 31 with edge 16 of sheet rock 18. Body 32 includes first threaded opening 28 piercing one of curved retaining sides 25 within which first thumb screw 29 engages. Body 32 further includes cut-out 27 centered on its lower edge opposite arm 31.

Base scale arm 11 includes graduated indicia 17 increasing from left to right and preferably from twelve inches to twenty-four inches at its left edge. Base scale arm 11 is channel shaped with curved retaining sides 23 sized to slidingly engage within curved retaining sides 25 of T-square arm 15. Once base scale arm 11 is slidingly engaged within body 32 of T-square arm 15, it may be selectively and reversibly fixed within body 32 by, for example, engaging first thumb screw 29 into first threaded opening 28 such that the distal end of first thumb screw 29 frictionally engages a portion of a base scale arm curved retaining side 23 fixing base scale arm 11 relative to body 32. As best shown in the cut-away portions of FIGS. 3 and 4, the bottom center of the left end of base scale arm 11 includes downwardly projecting tab 21 which is received within cut-out 27 to limit the left-most position of T-square arm 15 relative to base scale arm 11.

Sliding scale arm 13 is flat with a generally rectangular cross-section and includes graduated indicia 19 increasing from right to left and preferably from zero to twelve inches proximate set plate 51. Sliding scale arm 13 is sized to slidingly engage within curved retaining body sides 23 of base scale arm 11. The right end of sliding scale arm 13 includes a first diamond shaped opening 41. Channel shaped stop plate 35, with curved retaining sides 47, is attached to the right end of sliding scale arm 13 by, for example, screws 45 through threaded openings (not shown) in stop plate 35 and threaded openings (not shown) in the right end of sliding scale arm 13. Stop plate 35 is sized such that the left side of its retaining sides 47 abut the right side of base scale arm retaining sides 23 to limit the left-most position of sliding scale arm 13 relative to base scale arm 11.

Stop plate 35 includes a second diamond shaped opening 37 in alignment with first diamond shaped opening 41 in sliding scale arm 13. Cutting tool engagement member 14 includes first and second diamond shaped openings 41, 37 which are sized for receipt of a cutting blade of cutting tool 20 in the upper apex 38 and lower apex 40 of aligned first and second diamond shaped openings 41, 37. Other known devices may be used to retain cutting tool 20 to, for example, eliminate the need for manual positioning and holding of cutting tool 20. As discussed below, the reading of the appropriate graduated indicia 17, 19 at left edge 26 of sliding scale arm 13 and measuring line 69 at the right edge of curved sides 25, respectively, will determine measured distance 24 from the cutting blade of cutting tool 20 to leading edge 67 and sheet rock edge 16, respectively, to allow accurate measuring and cutting of sheet rock 18 in one motion.

It is noted that reading scale 19 of sliding scale arm 13 at the right hand edge of the upper curved side 25 of T-square arm body 32, or measuring line 69 formed between the right hand edges of curved sides 25 of T-square arm body 32, greatly facilitates accurate and precise measurement of desired distance 24 from the leading edge 67 of T-square arm 15 to the center of first and second diamond shaped openings 41, 37. This avoids having to read scale 19 at leading edge 67 of T-square arm 15 or edge 16 of sheet rock 18 which are below and further apart from scale 19.

Sliding scale arm 13 includes two spaced apart, upwardly projecting projections 49 on its left end opposite stop plate 35. Generally square shaped set plate 51 is sized to snugly fit between projections 49 and within curved retaining sides 23 of base scale arm 11 when sliding scale arm 13 is slidingly engaged in base scale arm 11. Reinforcing plate 53 is generally rectangularly shaped and is diagonally fixed to the center of set plate 51 by tack welding, for example.

Second threaded opening 55 pierces the approximate center of reinforcing plate 53 and set plate 51 within which second thumb screw 61 engages. Once sliding scale arm 13 is slidingly engaged within base scale arm 11, it may be selectively and reversibly fixed within base scale arm 11 by, for example, engaging second thumb screw 61 into second threaded opening 55 such that the distal end of second thumb screw 61 abuts a portion of the upper surface of sliding scale arm 13, pushing set plate 51 upwardly against the inside of a portion of curved retaining sides 23 frictionally fixing sliding scale arm 13 relative to base scale arm 11.

Alternatively, set plate 51 may be permanently attached to sliding scale arm 13 by, for example, rivets (not shown) so that set plate 51 does not separate from sliding scale arm 13 during use or disassembly of sheet rock cutting tool 10 thus eliminating the risk of loss of set plate 51. This would eliminate the need for projections 49. Attachment of set plate 51 in such a manner would still allow set plate 51 vertical play to permit frictional engagement and disengagement of set plate 51 against curved retaining sides 23 when second thumb screw 61 is turned.

Of course it is possible for sliding scale arm 13 to engage base scale arm 11 by other methods such as, for example, including a U-shaped channel (not shown) in the right end of base scale arm 11 extending proximate the left end of base scale arm 11. Instead of set plate 51 et al, sliding scale arm 13 may include an opening at its left end within which a thumb screw, for example, is freely inserted and which also freely fits within the U-shaped channel of base scale arm 11. A nut may be then engaged at the distal end of the thumb screw and which is flush with the bottom of base scale 11 to avoid contact with sheet rock 18 at selected measuring or cutting distances. Sliding scale arm 13 is then selectively fixed relative to base scale arm 11 by turning the thumb screw to frictionally engage sliding scale arm 13 and base scale arm 11.

Figure 3:
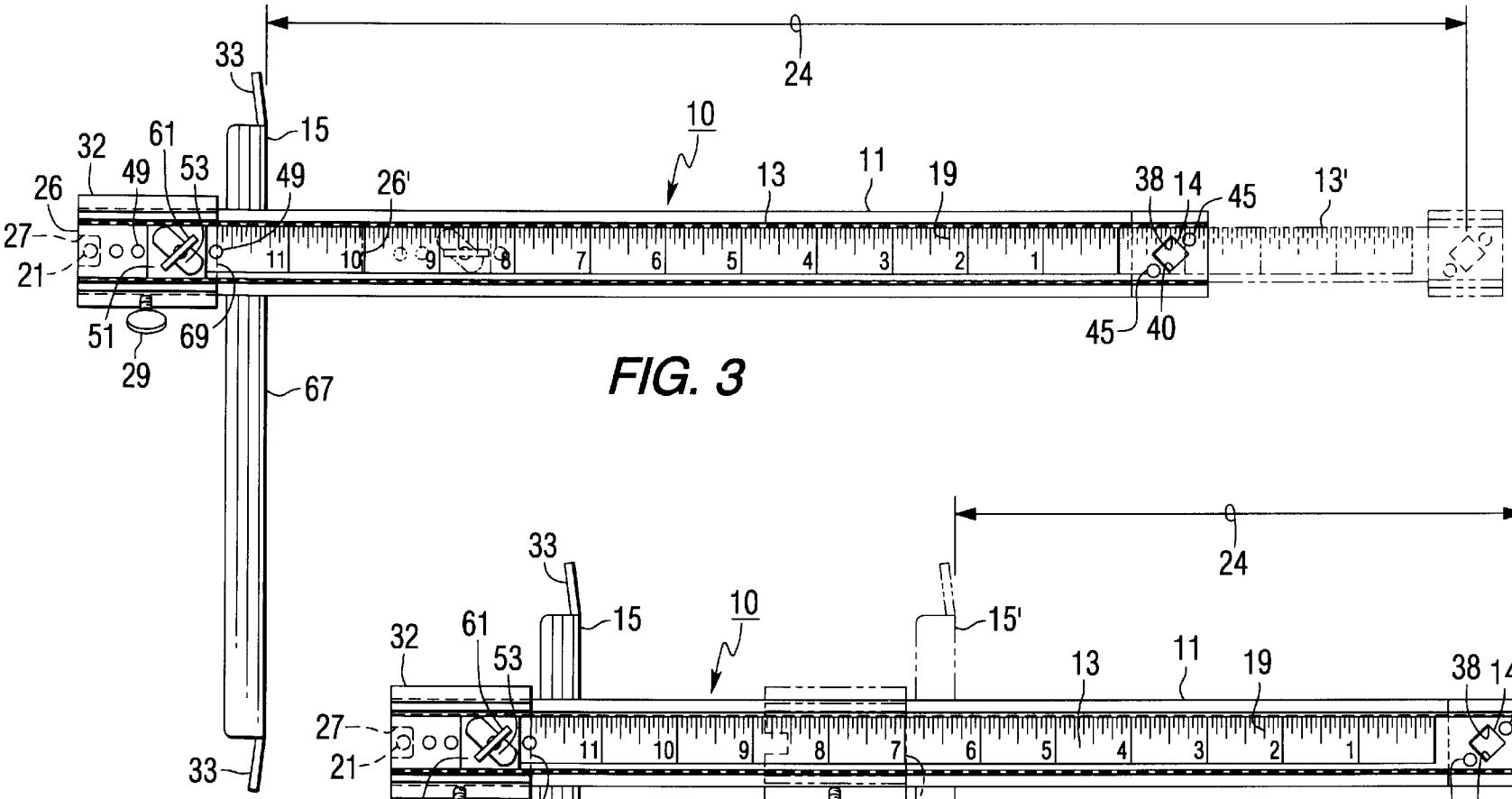
FIG. 3 is a partially cut-away, plan view of the sheet rock cutting tool of FIG. 1 showing the T-square arm locked in its left most position and the sliding scale arm at a second position in dotted line.

Use of sheet rock cutting tool 10 of the preferred embodiment of the present invention is as follows. In any case, leading edge 67 of T-square arm 15 is placed flush to abut an edge 16 of sheet rock 18 to be measured and/or cut. For measuring and cutting from more than twelve inches to twenty-four inches of the sheet rock 18 as shown in FIG. 3, T-square arm 15 is positioned and fixed at its left-most limit relative to base scale arm 11 by engaging tab 21 in cut-out 27 and engaging first thumb screw into first threaded opening 28. Sliding scale arm 13 is positioned relative to base scale arm 11 at the desired distance to be cut at 13' and second thumb screw 61 is engaged into second threaded opening 55 fixing sliding scale arm 13. The desired distance 24 is read on the base scale arm indicia 17 at the left edge 26' of sliding scale arm 13' which is the distance from the center of first and second diamond shaped openings 41, 37 to leading edge 67 and thus the length of the desired cut. Cutting tool 20, such as a utility knife, is inserted and held in cutting tool engagement member 14 such that the blade of utility knife 20 is held between the upper apex 38 and lower apex 40 and inserted to make the desired depth of cut. Sheet rock cutting tool 10 is then guided along edge 16 of sheet rock 18 maintaining the flush abutment of leading edge 67 of T-square arm 15 against edge 16 while utility knife 20 cuts or scores sheet rock 18 at the desired distance 24 from edge 16.

Figure 4:
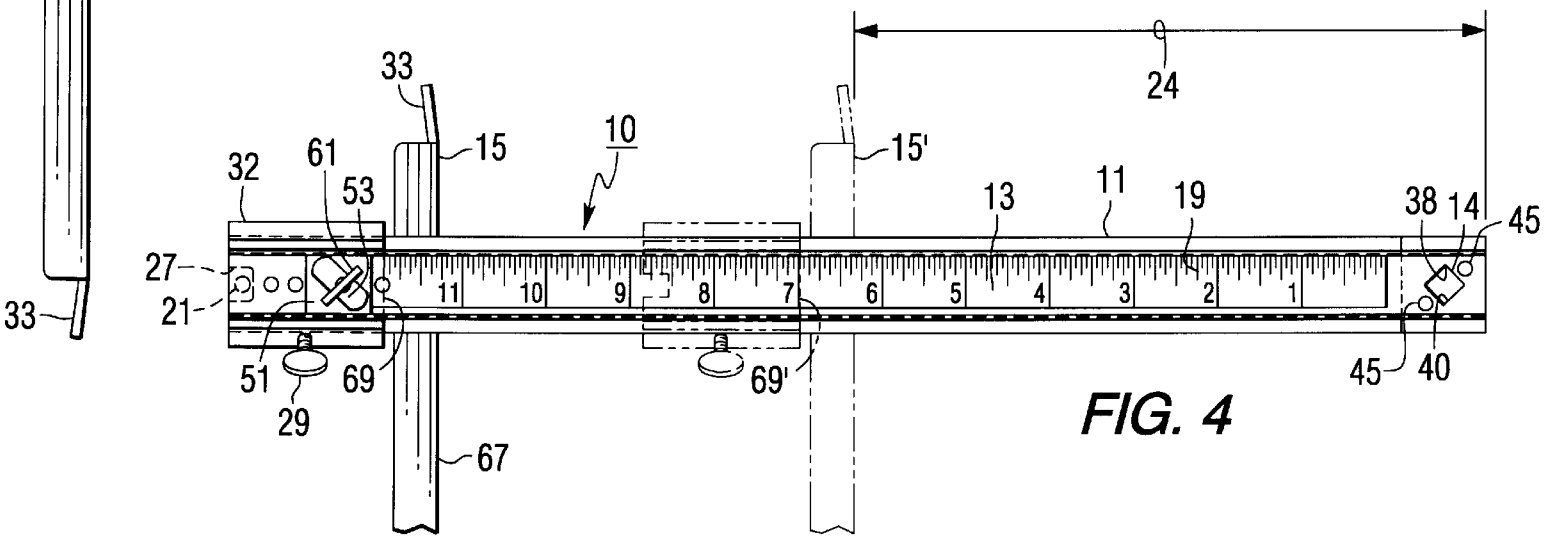
FIG.4 is a partially cut-away, plan view of the sheet rock cutting tool of FIG. 1 showing the sliding scale arm locked in its left most position and the T-square arm at a second position in dotted line.

For measuring and cutting from twelve inches to just over zero inches as shown in FIG. 4, sliding scale arm 13 is positioned and fixed at its left-most position relative to base scale arm 11 by engaging second thumb screw 61 into second threaded opening 55. Base scale arm 11, with sliding scale arm 13 fixed thereto, is positioned relative to T-square arm 15 at the desired distance 24 to be cut at 15' and first thumb screw 29 is engaged into first threaded opening 28 fixing base scale arm 11. The position of the right hand edge of the upper curved side 25 of T-square arm body 32, or measuring line 69', relative to sliding scale arm graduated indicia 19 gives the distance from the center of first and second diamond shaped openings 41, 37 to leading edge 67. Cutting tool 20, such as a utility knife, is inserted and held in cutting tool engagement member 14 such that the blade of utility knife 20 is held between the upper apex 38 and lower apex 40 and inserted to make the desired depth of cut. Sheet rock cutting tool 10 is then guided along edge 16 of sheet rock 18 maintaining the flush abutment of leading edge 67 of T-square arm 15 against edge 16 while utility knife 20 cuts or scores sheet rock 18 at the desired distance 24 from edge 16.

If it is desired to only measure or mark sheet rock 18, a pencil or other like marking device, not shown, may be inserted into an apex 38, 40 depending upon which direction sheet rock cutting tool 10 is guided along edge 16. For example if sheet rock cutting tool 10 is to be guided downwardly along sheet rock 18, a pencil is placed in upper apex 38. The motion of sheet rock cutting tool 10 downwardly tends to maintain engagement of the pencil in upper apex 38. Similarly, the pencil is placed in lower apex 40 if sheet rock cutting tool 10 is to be guided upwardly along sheet rock 18.

While particular embodiments of the present invention have been illustrated and described, it is not intended to limit the invention, except as defined by the following claims.

I claim:

1. A sheet rock measuring and cutting device, comprising:

a T-square arm for abutment with an edge of a piece of sheet rock;

a base scale arm positioned within said T-square arm for selective sliding interengagement therewith;

a sliding scale arm positioned within said base scale arm for selective sliding interengagement therewith; said sliding scale arm including a cutting tool engagement means for receipt and positioning of a cutting tool at a measured distance from said T-square arm; and said cutting tool engagement means being an opening in said sliding scale arm through which said cutting tool is manually insertable to cut said sheet rock.

2. The device of claim 1, wherein said T-square arm includes a body, and an arm perpendicular to said body; said arm having a leading edge for abutment with said edge of a piece of sheet rock; and wherein said base scale arm is positioned within said body for selective sliding interengagement therein and is perpendicular to said edge.

3. A sheet rock measuring and cutting device, comprising:

a T-square arm for abutment with an edge of a piece of sheet rock;

a base scale arm positioned within said T-square arm for selective sliding interengagement therewith;

a sliding scale arm positioned within said base scale arm for selective sliding interengagement therewith; said sliding scale arm including a cutting tool engagement means for receipt and positioning of a cutting tool at a measured distance from said T-square arm;

said T-square arm having a body, and an arm perpendicular to said body, said arm having a leading edge for abutment with said edge of a piece of sheet rock; and wherein said base scale arm is positioned within said body for selective sliding interengagement therein and is perpendicular to said edge; and said base scale arm having graduated indicia thereon increasing from left to right and said sliding scale arm includes graduated indicia thereon increasing from right to left.

4. The device of claim 3, wherein said sliding scale arm graduated indicia commences at zero and increases to n units and said base scale arm graduated indicia commences at n units and increases to 2n units.

5. The device of claim 4, wherein n equals twelve inches.

6. A sheet rock measuring and cutting device, comprising:

a T-square arm for abutment with an edge of a piece of sheet rock;

a base scale arm positioned within said T-square arm for selective sliding interengagement therewith;

a sliding scale arm positioned within said base scale arm for selective sliding interengagement therewith; said sliding scale arm including a cutting tool engagement means for receipt and positioning of a cutting tool at a measured distance from said T-square arm;

said T-square arm having a body, and an arm perpendicular to said body; said arm having a leading edge for abutment with said edge of a piece of sheet rock; and wherein said base scale arm is positioned within said body for selective sliding interengagement therein and is perpendicular to said edge;

a first engagement means for selectively fixing said T-square arm relative to said base scale arm; and a second engagement means for selectively fixing said sliding scale arm relative to said base scale arm.

7. The device of claim 6, wherein said first engagement means are mounted on said T-square arm.

8. The device of claim 7, wherein said second engagement means are mounted on said sliding scale arm.

9. The device of claim 6, further including a first limit means for limiting the left-most positioning of said T-square arm on said base scale arm; and a second limit means for limiting the left-most positioning of said sliding scale arm within said base scale arm; such that when said T-square is fixed at its said left-most position on said base scale arm and said sliding scale arm is fixed at its said left-most position within said base scale arm, the distance from said leading edge to the cutting edge of said cutting tool is n units.

10. The device of claim 9, wherein said first engagement means comprises a first thumb screw and a first threaded opening piercing said body of said T-square arm sized to receive said first thumb screw such that threading said first thumb screw into said first threaded opening causes the end of said first thumb screw to engage said base scale arm selectively fixing said T-square arm at a predetermined position along said base scale arm;

said second engagement means comprising two projections on the left side of said sliding scale arm spaced apart a predetermined distance, a generally square shaped plate sized to fit within said base scale arm and resting on said sliding scale arm between said projections, a second thumb screw, said plate pierced by a second threaded opening centered therein and sized to receive said second thumb screw such that threading said second thumb screw into said second threaded opening causes the end of said second thumb screw to engage said sliding scale arm pressing said plate upwardly against a portion of said base scale arm and selectively fixing said sliding scale arm at a predetermined position along said base scale arm;

said first limit means comprises a downwardly projecting tab on the left underside of said base scale arm and a cut-out on the left side of said body of said T-square arm sized for receipt of said tab;

said second limit means comprises a stop plate fixedly mounted on the right end of said sliding scale arm such that said stop plate contacts said base scale arm at said sliding scale arm's left most position; and said cutting tool engagement means comprises a first diamond shaped opening in the right end of said sliding scale arm a second diamond shaped opening in said stop plate in alignment with said first diamond shaped opening; said first and second diamond shaped openings being sized for receipt of a cutting blade of said cutting tool.

11. A sheet rock measuring and cutting device, comprising;

a T-square arm having a body and an arm perpendicular to said body; said arm having a leading edge for abutment with an edge of a piece of sheet rock;

a base scale arm having graduated indicia thereon and positioned within said body of said T-square arm for selective sliding interengagement therewith and perpendicular to said arm of said T-square arm;

a sliding scale arm having graduated indicia thereon and positioned within said base scale arm for selective sliding interengagement therewith; said sliding scale arm including a cutting tool engagement means at one end thereof for receipt and positioning of a cutting tool at a distance from said leading edge of said arm of said T-square arm; said distance being indicated by one of said graduated indicia relative to said leading edge; and said cutting tool engagement means being an opening in said sliding scale arm through which said cutting tool is manually insertable to cut said sheet rock.

12. A sheet rock measuring and cutting device, comprising;

a T-square arm; said T-square arm including a body having upwardly curved sides, and an arm perpendicular to said body; said arm having a leading edge for abutment with an edge of a piece of sheet rock;

a base scale arm having graduated indicia thereon increasing from left to right from n units to 2n units and further having upwardly curved sides; said base scale arm being positioned within said body perpendicular to said arm and retained by said body sides for selective sliding interengagement therein;

a sliding scale arm having graduated indicia thereon increasing from right to left from zero to n units; said sliding scale arm positioned within said base scale arm and retained by said base scale arm sides for selective sliding interengagement therewith;

a first thumb screw and a first threaded opening piercing said body of said T-square arm sized to receive said first thumb screw and positioned such that threading said first thumb screw into said first threaded opening causes the end of said first thumb screw to engage said base scale arm selectively fixing said base scale arm within said T-square arm body;

two projections on the left side of said sliding scale arm spaced apart a predetermined distance, a second thumb screw, a generally square shaped plate sized to fit within said base scale arm and resting on said sliding scale arm between said projections, said plate pierced by a second threaded opening centered therein and positioned and sized to receive said second thumb screw such that threading said second thumb screw into said second threaded opening causes the end of said second thumb screw to engage said sliding scale arm pressing said plate upwardly against a portion of said base scale arm sides and selectively fixing said sliding scale arm within said base scale arm;

a downwardly projecting tab on the left underside of said base scale arm and a cut-out on the left side of said body of said T-square arm sized for receipt of said tab wherein engagement of said tab with said cut-out limits the left-most positioning of said T-square arm on said base scale arm;

a stop plate fixedly mounted on the right end of said sliding scale arm sized to abut the right end of said base scale arm wherein abutment of said stop plate with said right end of said base scale arm limits the left-most positioning of said sliding scale arm within said base scale arm;

a first diamond shaped opening piercing the right end of said sliding scale arm; and a second diamond shaped opening piercing said stop plate and in alignment with said first diamond shaped opening; said first and second diamond shaped openings being sized for receipt of a cutting blade of said cutting tool at a measured distance from said T-square arm;

such that when said T-square arm is fixed at its said left-most position on said base scale arm, and said sliding scale arm is fixed at its said left-most position within said base scale arm, the distance from said leading edge to the cutting edge of said cutting blade is n units.

* * * * *